US007121800B2

(12) United States Patent
Beattie

(10) Patent No.: US 7,121,800 B2
(45) Date of Patent: Oct. 17, 2006

(54) TURBINE BLADE NESTED SEAL DAMPER ASSEMBLY

(75) Inventor: Jeffrey Beattie, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 13 days.

(21) Appl. No.: 10/939,766

(22) Filed: Sep. 13, 2004

(65) Prior Publication Data

US 2006/0056974 A1 Mar. 16, 2006

(51) Int. Cl.
*F01D 5/26* (2006.01)
*F01D 25/04* (2006.01)

(52) U.S. Cl. ..... 416/190; 416/193 A

(58) Field of Classification Search ..... 416/190, 416/103 A, 219 R, 221, 500, 193 A
See application file for complete search history.

(56) References Cited

U.S. PATENT DOCUMENTS 4,101,245 A * 7/1978 Hess et al. ..... 416/190
4,177,013 A * 12/1979 Patterson et al. ..... 416/193 A
4,516,910 A * 5/1985 Bouiller et al. ..... 416/190
5,228,835 A * 7/1993 Chlus ..... 416/193 A
5,415,526 A * 5/1995 Mercadante et al. ..... 416/190
5,573,375 A * 11/1996 Barcza ..... 416/193 A
5,785,499 A 7/1998 Houston et al.
5,924,699 A * 7/1999 Airey et al. ..... 416/193 A
6,171,058 B1 1/2001 Stec
6,273,683 B1 8/2001 Zagar et al.
6,315,298 B1 11/2001 Kildea et al.
6,471,484 B1 10/2002 Crall
6,475,935 B1 11/2002 Ishizaki et al.

FOREIGN PATENT DOCUMENTS

EP 0 717 169 6/1996
JP 11081906 3/1999
WO WO 95/27841 10/1995

OTHER PUBLICATIONS

Australian Search Report dated Apr. 12, 2006.

* cited by examiner

*Primary Examiner*—Igor Kershteyn
(74) *Attorney, Agent, or Firm*—Carlson, Gaskey & Olds

(57) ABSTRACT

A turbine blade damper seal assembly includes a seal and a damper that both abut a radially outermost non-gas path surface. The seal is fabricated from a plastically deformable material and nests within a recess of the damper. The damper is fabricated from a rigid material that absorbs vibrational energy generated during operation. The recess within the damper provides for both the damper and the seal to be positioned at the radially outermost non-gas path surface.

27 Claims, 3 Drawing Sheets

TURBINE BLADE NESTED SEAL DAMPER ASSEMBLY

The US Government may have certain rights in this invention in accordance with Contract Number N00019-02-C-3003 awarded by the United States Navy.

BACKGROUND OF THE INVENTION

This application relates generally to a turbine seal and damper assembly and specifically to a nested seal and damper assembly.

Conventional gas turbine engines include a turbine assembly that has a plurality of turbine blades attached about a circumference of a turbine rotor. Each of the turbine blades is spaced a distance apart from adjacent turbine blades to accommodate movement and expansion during operation. The blades typically include a root that attaches to the rotor, a platform and a blade that extends radially outwardly from the platform.

Problems arise when hot gases penetrate below the platform of the turbine blades. Hot gases flowing over the platform are prevented from leaking between adjacent turbine blades by a seal. This is done because components below the platform are generally not designed to operate for extended durations at the elevated temperatures of the hot gases. The seal is typically a metal sheet nested between adjacent turbine blades on an inner surface of the platform. The seal is typically flexible so as to conform to the inner surface of the platform and prevent the intrusion of hot gases below the platform of the turbine blade. Typically, the seal is disposed against a radially outboard inner surface of the platform of the turbine blade.

In addition to the seal it is common practice to include a damper between adjacent turbine blades to dissipate potentially damaging vibrations. A damper is typically sized to provide sufficient mass and rigidity to dissipate vibration from the turbine blade. Vibrations from the turbine blade are transmitted through frictional contact between the damper and an inner surface of the turbine blade platform. Dampers provide the maximum benefit and dampening when positioned at a radial outermost part of an inner surface of the platform.

Disadvantageously, both the damper and the seal perform to the maximum benefit when positioned against the inner surface of the platform. As appreciated, it is only possible to position either the seal or the damper immediately adjacent the inner surface.

A currently proposed solution provides a single part that performs as both the seal and as the damper. Such a device provides for the desired location of both the damper and the seal. However, the material properties of the seal and the damper are compromised to accommodate the separate functions. That is the seal material is not as flexible as desired in order to provide the dampening properties required and the damper material does not provide the most beneficial dampening properties in order to provide some flexibility for the seal. The compromise between favorable dampening properties and favorable seal properties yields less than desirable performance for both functions.

Accordingly, it is desirable to develop a seal and damper assembly utilizing the most beneficial material for each function while providing the most beneficial placement of the damper and seal.

SUMMARY OF THE INVENTION

This invention is a damper-seal assembly for a turbine blade that includes a seal nested within a damper such that both the seal and damper are disposed at an interior outer most surface of the turbine blade.

The damper-seal assembly includes the seal that prevents hot gases from penetrating a gap between adjacent turbine blades. The seal abuts the inner surface of the platform and bridges the gap to block the flow of hot gases. The damper includes a recess within which the seal nests. On each side of the recess the damper includes a surface that contacts the inner most surfaces of the turbine blade. The surface of the damper provides frictional contact that absorbs vibrational energy from the turbine blade generated during operation.

The damper-seal assembly is assembled within a cavity of the turbine blade such that both the damper and the seal are adjacent the inner surface. Both the damper and the seal provide the most benefit by being located at the radially outermost point within the cavity.

The damper-seal assembly of this invention provides for the use of separate material for the seal and the damper while providing for optimal placement of both the seal and the damper. The seal includes a plastically deformable material that provides the desired seal to prevent the intrusion of hot gases and the damper provides the dense rigid structure necessary for absorbing vibrational energy generated during operation.

Accordingly, the damper-seal assembly of this invention provides for the most beneficial material for each function and the most beneficial placement of the damper and seal.

These and other features of the present invention can be best understood from the following specification and drawings, the following of which is a brief description.

DETAILED DESCRIPTION OF THE PREFERRED EMBODIMENT

Figure 1:
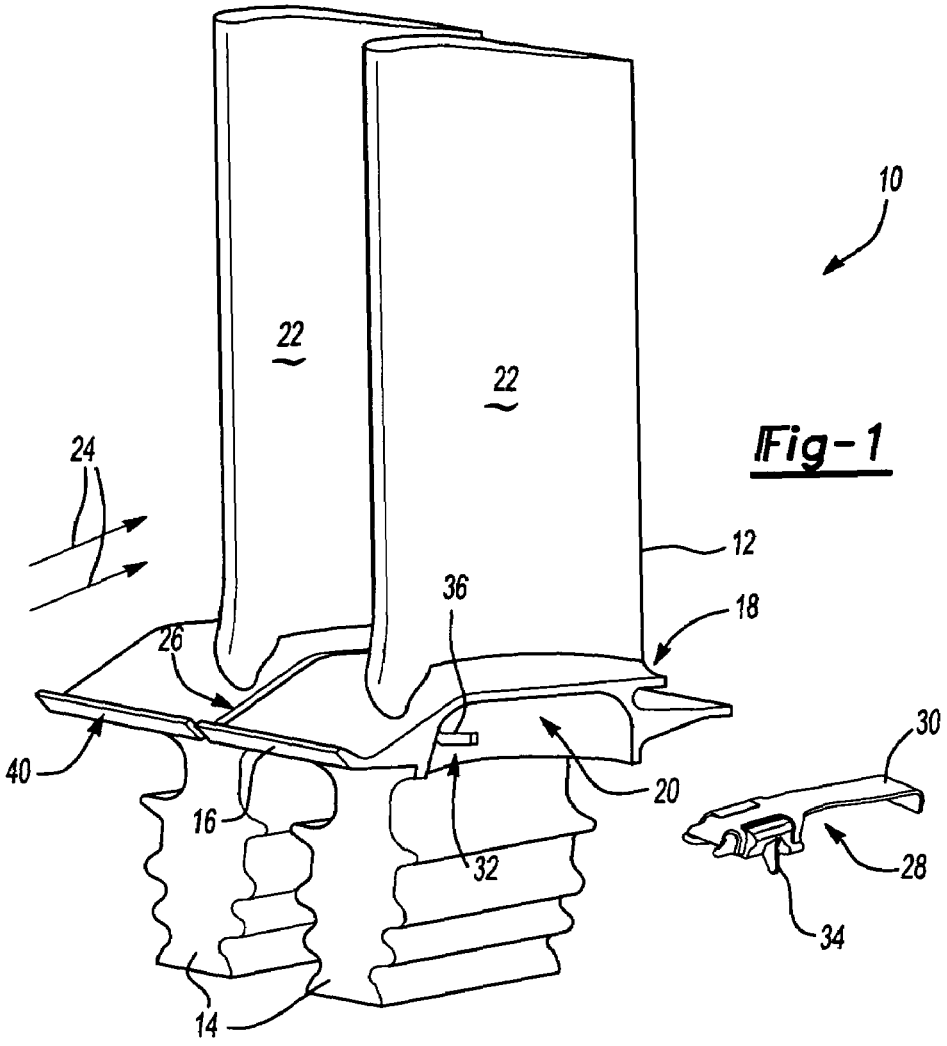
FIG. 1 is a perspective view of adjacent turbine blade assemblies.

Referring to FIG. 1, a turbine assembly 10 includes a plurality of adjacent turbine blades 12. Each of the turbine blades 12 includes a root 14 that is fit into a radial slot of a turbine rotor (not shown). Radially outward of the root 14 is a platform 16. The platform 16 includes an outer surface 18 and an inner surface 20. The inner surface 20 is disposed radially inward of the outer surface 18. An airfoil 22 extends upward from the platform 16.

Hot gas 24 flows around the airfoil 22 and over the outer surface 18. A gap 26 extends axially between adjacent turbine blades 12. The gap 26 prevents contact between the turbine blades 12. A damper-seal assembly 28 includes a seal 30 that prevents hot gases 24 from penetrating the gap 26 and penetrating the underside of the platform 16. The seal 30 is positioned within a cavity 32 formed between adjacent turbine blades 12. The seal 30 abuts the inner surface 20 of the platform 16 and bridges the gap 26 to block the flow of hot gases. The cavity 32 of the turbine blade 12 includes a nub 36 for aligning and positioning the damper-seal assembly 28.

Figure 2:
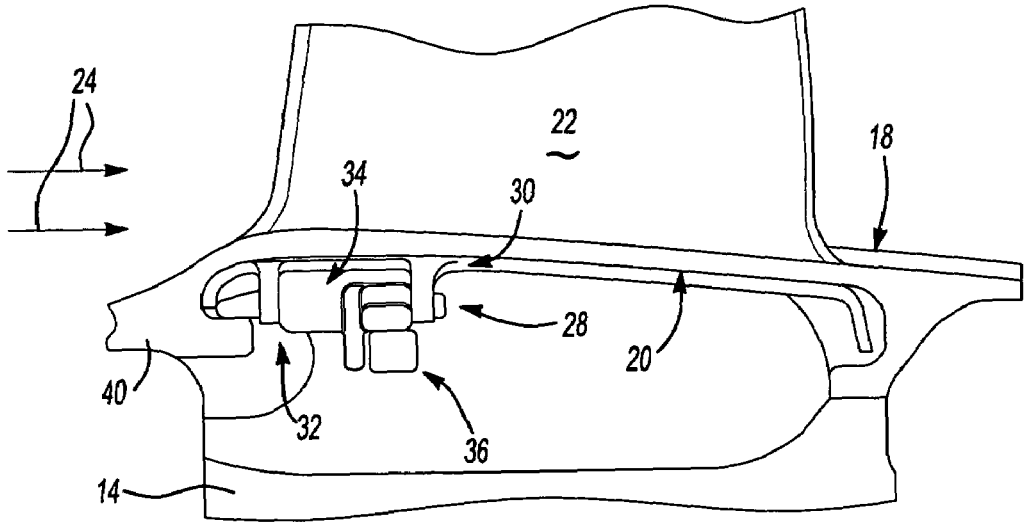
FIG. 2 is a side view of a damper seal assembly within the turbine blade.

Referring to FIG. 2, the damper-seal assembly 28 is assembled within the cavity 32 of the turbine blade 12 such that both the damper 34 and the seal 30 are adjacent the inner surface 20. Both the damper 34 and the seal 30 provide the most benefit by being located at the radially outermost point within the cavity 32. The radial most position is where the damper 34 abuts and is in frictional contact with the inner surface 20. Frictional contact between the damper 34 and the inner surface 20 absorbs and dissipates vibrational energy generated during operation. Axial placement of the damper 34 substantially maximizes vibration-dampening performance. Preferably, the damper 34 is positioned within the cavity 32 to maximize vibration-dampening performance. The damper 34 is illustrated in a forward most position. Although the damper 34 is shown in the forward most position, one skilled in the art with the benefit of this disclosure would understand that other configurations of the damper 34 are within the contemplation of this invention.

Figure 3:
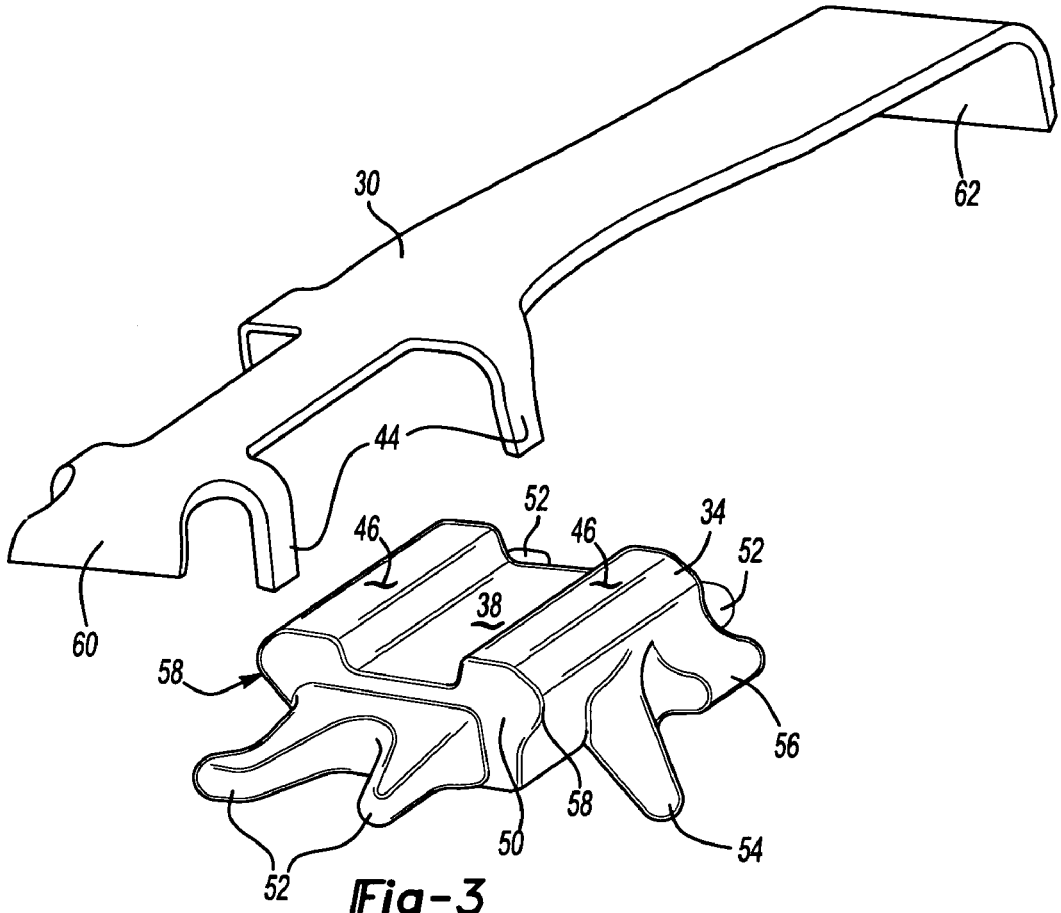
FIG. 3 is an exploded view of the damper seal assembly.
Figure 4:
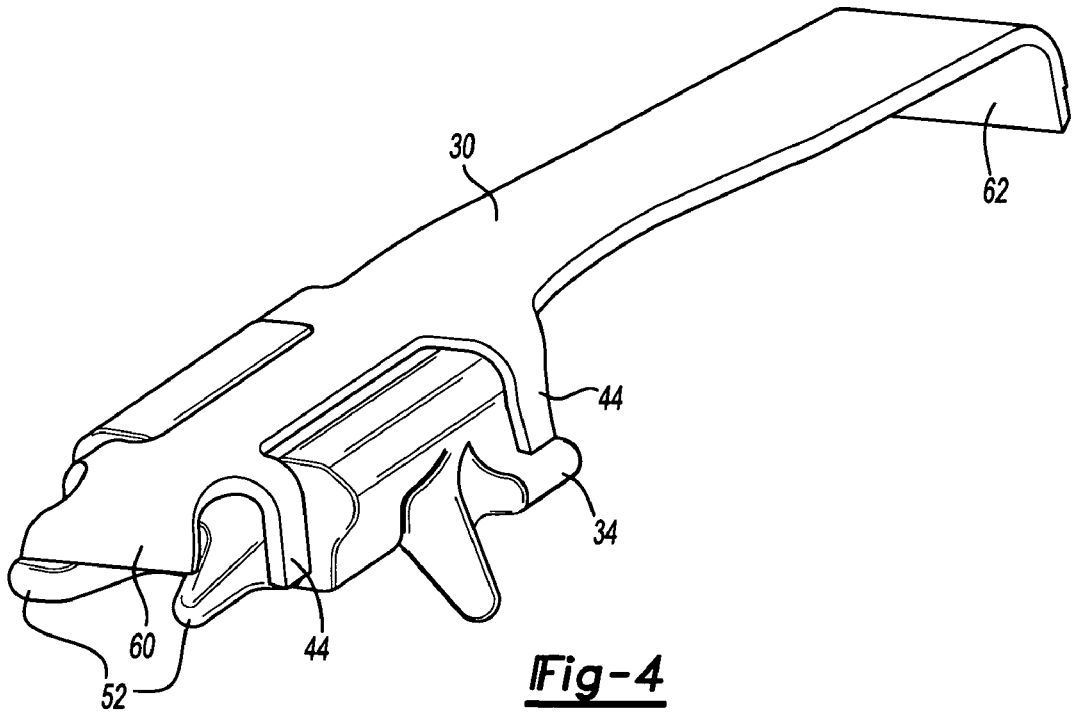
FIG. 4 is a perspective view of the damper seal assembly.

Referring to FIGS. 3 and 4, the seal 30 nests within a recess 38 of the damper 34. The recess 38 provides for the seal 30 and a portion of the damper 34 to both abut the inner surface 20 of the platform 16. The recess 38 extends axially along a top surface of the damper 34. The seal 30 includes fingers 44 that interfit onto the damper 34 and secure the seal 30 and the damper 34 together. The fit between the damper 34 positions the seal 30 relative to the damper 34 and thereby relative to the gap 26 between adjacent turbine blades 12.

The damper 34 includes a body portion 50 and seal retention arms 52 that extend forward of the body portion 50 for supporting a forward portion of the seal 30. The damper 34 includes rub surfaces 46 disposed on either side of the recess 38. The rub surfaces 46 are in frictional contact with the inner surface 20 along a plane common with the seal 30. The damper 34 includes retention features 54 that correspond to the cavity 32 to position and secure the damper-seal assembly 28 relative to the inner surface 20. An alignment feature 56 is also included and juts from the body 50 on each side of the damper 34. Stiffening portions 58 extend the rub surfaces 46 on each side of the damper 34. The stiffening portions 58 strengthen and reinforce the rub surfaces 46.

The damper 34 is fabricated from a material that does not plastically deform under the thermal and centrifugal loads produced during operation. Further the material utilized for the damper 34 is selected to provide desired vibration dampening properties in addition to the thermal capacity. The damper 34 is placed under centrifugal loading against the inner surface 20 of the platform 16. Although a preferred configuration of the damper 34 is shown, a worker with the benefit of this disclosure would understand that different configurations and features of the damper 34 are within the contemplation of this invention and dependent on application specific requirements.

The seal 30 is preferably a thin sheet of metal that includes a forward portion 60 that fits onto the retention arms 52 of the damper 34. The fingers 44 interfit the damper 34 and hold the seal 30 nested within the recess 38. The seal 30 is preferably flexible to conform to the inner surface 20 to provide a desired seal against the intrusion of hot gases 24 under the turbine blade 12. A rearward portion 62 extends axially rearward and extends inboard to conform and seal with the configuration of the axially extending gap 26. The material utilized for the seal 30 is selected to withstand the pressures and temperatures associated with a specific application and to allow for some plastic deformation. The seal 30 plastically deforms responsive to the thermal and centrifugal loads to conform and fit the contours of the inner surface 20. The plastic deformation provides a desired seal against the intrusion of hot gases 24.

Figure 5:
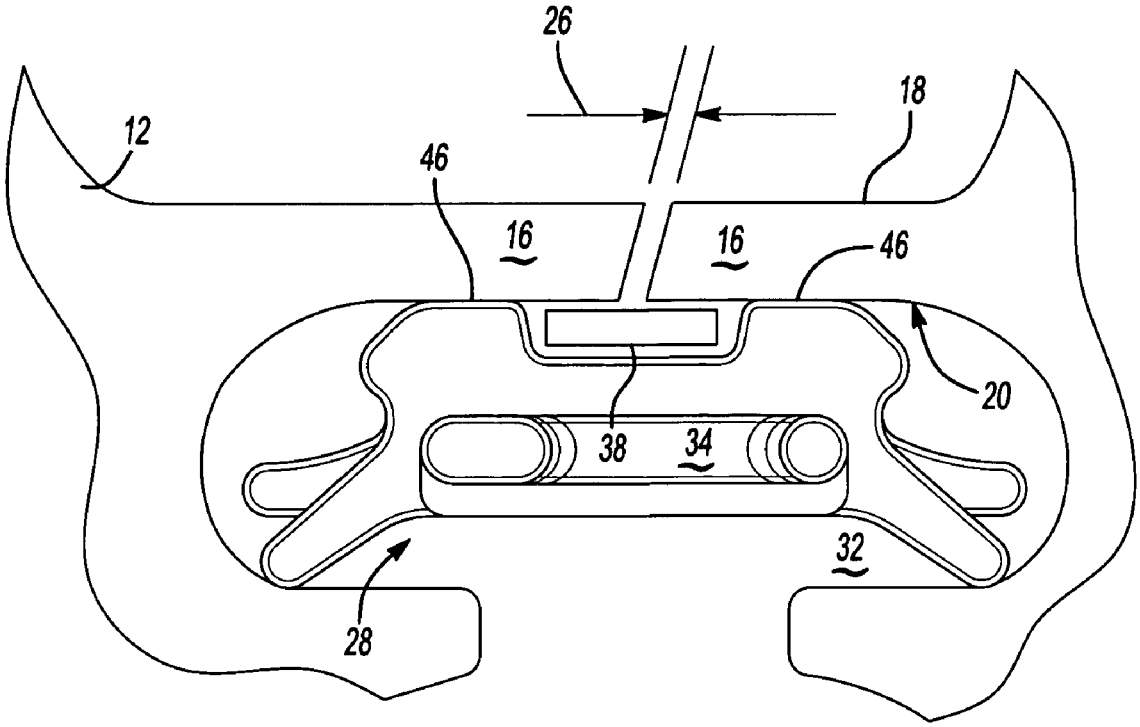
FIG. 5 is a schematic view of placement of the damper seal assembly.

Referring to FIG. 5, the damper-seal assembly 28 is shown within the cavity 32 defined by adjacent turbine blades 12. The rub surfaces 46 contact the inner surface 20. The damper 34 performs the most benefit at the radially outer most portion on a non-gas path side of the turbine blade 12. The frictional contact between the damper 34 and the inner surface 20 of the turbine blade 12 dampens vibrations generated during operation. The seal 30 is disposed along the axial gap 26 on the inner surface 20. The recess 38 provides for continuous contact of the seal 30 along the inner surface 20 of adjacent turbine blades 12 along the entire axial gap 26 while providing the beneficial outermost radial position for the damper 34.

The damper-seal assembly 28 of this invention provides for the use of separate material for the seal 30 and the damper 34 while providing for optimal placement of both the seal 30 and the damper 34. The seal 30 includes a plastically deformable material that provides the desired seal to prevent the intrusion of hot gases 24 and the damper 34 provides the dense rigid structure necessary for absorbing vibrational energy generated during operation.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine assembly comprising:

a plurality of turbine blades spaced apart from each other, wherein each of said plurality of turbine blades includes a platform structure including an inner surface radially inboard of an outer surface;

a damper comprising a portion disposed adjacent said inner surface and a recess extending axially between rub surfaces; and a seal nested with said damper and disposed adjacent said inner surface and within the recess between the rub surfaces, wherein the seal is longer than the damper.

2. The assembly as recited in claim 1, wherein said seal comprises tab portions that fit onto said damper.

3. The assembly as recited in claim 2, wherein said damper comprises alignment features for aligning said damper relative to each of said plurality of turbine blades.

4. The assembly as recited in claim 3, wherein said alignment features jut outwardly from a body of said damper.

5. The assembly as recited in claim 1, wherein each of said plurality of turbine blades comprises a forward portion and a rearward portion and said inner and outer surfaces extend therebetween, said damper disposed adjacent said forward portion.

6. The assembly as recited in claim 1, wherein said seal comprises a thin sheet of metal.

7. The assembly as recited in claim 1, wherein said damper comprises a molded mass.

8. The assembly as recited in claim 1, wherein said damper and said seal are both disposed in a radially most outboard position.

9. The assembly as recited in claim 1, wherein adjacent turbine blades define a cavity into which said damper and seal are disposed.

10. The assembly as recited in claim 9 wherein said damper is disposed in a forward most portion of said cavity.

11. The assembly as recited in claim 10, wherein each of said plurality of turbine blades include an alignment feature for positioning said damper within said cavity.

12. A damper seal assembly for a turbine blade comprising:

a damper comprising two contact surface abutting an inner surfaces of a cavity within a root of the turbine blade, and a recess disposed between the two contact surfaces; and a seal nested with said recess of the damper and abutting the inner surface of the cavity within the root of the turbine blade.

13. The assembly as recited in claim 12, including a plane defined across said damper by said contact surface wherein a surface of said seal is disposed within said plane.

14. The assembly as recited in claim 12, wherein said damper includes retention features corresponding with the inner surface of the turbine blade.

15. The assembly as recited in claim 12, wherein a surface of said seal and said contact surface of said damper abut a radially outermost non-gas path side of the turbine blade.

16. A damper seal assembly comprising:

a damper comprising a body and at least two rub surfaces extending from the body and separated from each other by a recess; and a seal disposed within the recess comprising a forward portion with fingers projecting therefrom and a rearward portion extending axially a length beyond the damper and including a projection at least in part co-directionally with the fingers.

17. The assembly as recited in claim 16, wherein said seal includes tab portions that fit onto said damper.

18. The assembly as recited in claim 17, wherein said seal is adapted to fit within said recess of said body.

19. The assembly as recited in claim 18, wherein said at least two rub surfaces and a surface of said seal form a common plane.

20. A damper comprising:

a body;

at least two rub surfaces extending from the body and separate from each other by a recess;

a pair of retention arms extending from a forward portion of the body; and an alignment feature that juts from the body on opposing sides of the body.

21. The damper as recited in claim 20, including at least one finger extending longitudinally from said body.

22. The damper as recited in claim 20, wherein said at least two rub surfaces extend longitudinally along said body.

23. The damper as recited in claim 20, including at least one lug extending laterally from said body.

24. The damper as recited in claim 20, including at least two lugs disposed on opposite sides of said body.

25. A seal comprising:

a forward segment including a pair of fingers projecting from each side of the seal, wherein the pair of fingers are spaced a distance from each other and extend downwardly from the seal; and a rearward segment spaced an axial distance from the forward segment that includes a projection at least in part extending co-directionally with each of the pair of fingers.

26. The seal as recited in claim 25, including a body segment defining a plane, wherein said fingers project at least in part transverse to said plane.

27. The seal as recited in claim 26 wherein the pair of fingers project transversely from said body segment on a common side.

* * * * *